United States Patent [19]

Yoshida et al.

[11] Patent Number: 4,849,133

[45] Date of Patent: Jul. 18, 1989

[54] PTC COMPOSITIONS

[75] Inventors: Shingo Yoshida; Takahisa Akatsuka, both of Ushiku; Osamu Inoue, Kukizaki; Jiro Toyama, Nagareyama, all of Japan

[73] Assignee: Nippon Mektron, Ltd., Tokyo, Japan

[21] Appl. No.: 19,156

[22] Filed: Feb. 26, 1987

[30] Foreign Application Priority Data

Oct. 24, 1986 [JP] Japan ..... 61-253490

[51] Int. Cl.[4] ..... H01B 1/06

[52] U.S. Cl. ..... 252/511; 252/503; 252/506; 252/512; 252/513; 252/518; 252/514; 264/105; 524/495; 524/496; 524/433; 524/492; 524/439; 524/440; 524/493; 219/553

[58] Field of Search ..... 252/511, 512, 513, 514, 252/516, 518, 503; 264/105; 524/495, 496, 430, 433, 437, 439, 440, 492, 493; 219/553, 548, 552, 510; 338/22 R, 34, 35

[56] References Cited

U.S. PATENT DOCUMENTS

| | | | |
|---|---|---|---|
| 4,388,607 | 6/1983 | Toy et al. | 252/511 |
| 4,514,620 | 4/1985 | Cheng et al. | 252/511 |
| 4,560,498 | 12/1985 | Horsma et al. | 252/511 |
| 4,629,869 | 12/1986 | Bronnwall | 252/511 |
| 4,732,701 | 3/1988 | Nishii et al. | 252/511 |

*Primary Examiner*—Josephine Barr

*Attorney, Agent, or Firm*—Wegner & Bretschneider

[57] ABSTRACT

A PTC composition comprising at least one polymer, from 5% to 45% by volume of electrically conductive or semiconductive particles having a room temperature electric conductivity of at least $10^2$ [s/m] dispersed in said polymer, and from 0.2% to 20% by volume of thermally conductive particles having a room temperature electric conductivity of no more than $10^{-3}$ [s/m] and a thermal conductivity of at least 20 [w/m·k] dispersed in said polymer. A PTC device using such a PTC composition has a high ratio of peak resistance to room temperature resistance, and exhibits high safety.

6 Claims, 1 Drawing Sheet

PTC COMPOSITIONS

BACKGROUND OF THE INVENTION

This invention relates to an electrical material, a process for producing the same, and uses thereof and, more particularly, to a material composition having specific properties of sharply increasing its electrical resistance within a relatively narrow temperature range with increasing a temperature [PTC characteristics (positive temperature coefficient)], i.e., to a PTC composition.

PTC compositions can be utilized in a heater wherein heat generation is ceased when it is raised to a specific temperature; in a PTC thermistor; in a heat-sensitive sensor; and a circuit protection device wherein when a circuit containing a cell or the like exhibits a short the current flowing through the circuit is restricted to a predetermined value or less due to the increase of a resistance value, whereas when its short is released the circuit is restored. Currently, various materials have been developed as the PTC compositions. Heretofore, there have been developed $BaTiO_3$ having a monovalent of trivalent metal oxide incorporated therein, and polymers such as polyethylene and ethylene-acrylic acid copolymers having electrically conductive particles such as carbon black uniformly dispersed therein.

A process for preparing this PTC composition generally comprises incorporating a necessary amount of carbon black in one or more resins used as polymers and kneading them.

Further, PTC composition is utilized in a PTC device wherein this composition is sandwiched or interposed between metallic electrode plates.

Preferred characteristics of PTC compositions used as the PTC device or the like are a large resistance value at a high temperature (a peak resistance), and a low resistance value at room temperature (a room temperature resistance), i.e., a high ratio of peak resistance to room temperature resistance. Further, it is desirable to increase the spacing between electrodes in order to obtain devices having high safety, and to prevent a short between the electrodes.

However, in the prior art PTC compositions and processes for producing the same, even if the thickness of the PTC composition sandwiched between the electrodes is increased in order to produce devices having high safety, a high peak resistance value in proportion to the thickness is not always obtained. In the case of PTC compositions having a certain thickness or above, the peak resistance value reaches a plateau.

SUMMARY OF THE INVENTION

A general object of the present invention is to provide a PTC device having a high ratio of peak resistance to room temperature resistance and exhibiting high safety.

Another object of the present invention is to provide a PTC composition capable of producing a PTC device having an increased thickness without reaching a plateau of a peak resistance even if the thickness is increased.

A further object of the present invention is to provide a process for preparing a PTC composition capable of preventing discharge breakdown between device terminals.

We have carried out various tests and studies in order to accomplish the objects described above. We have now found that, when an appropriate amount of thermally conductive particles is incorporated in a polymer, a composition having good characteristics is obtained.

A PTC composition according to the present invention comprises at least one polymer, from 5% to 45% by volume of electrically conductive or semiconductive particles having a room temperature electric conductivity of at least $10^2$ [s/m] dispersed in said polymer, and from 0.2% to 20% by volume of thermally conductive particles having a room temperature electric conductivity of no more than $10^{-3}$ [s/m] and a thermal conductivity of at least 20 [w/m·k] dispersed in said polymer.

In a preferred embodiment of a PTC composition of the present invention, thermally conductive particles can composed of at least one material selected from silicon, SiC, $Si_3N_4$, beryllia, selenium, and alumina.

In a preferred embodiment of a PTC of the present invention, thermally conductive particles can have an average particle size of from 1 to 200 micrometers.

In another embodiment of the present invention, a process for preparing a PTC composition comprises incorporating from 5% to 45% by volume of electrically conductive or semiconductive particles having a room temperature electric conductivity of at least $10^2$ [s/m] and from 0.2% to 20% by volume of thermally conductive particles having a room temperature electric conductivity of no more than $10^{-3}$ [s/m] and a thermal conductivity of at least 20 [w/m·k], in at least one polymer, and kneading the mixture in a temperature range of from the highest melting point Tm among the melting points of the polymers to be kneaded to Tm+80° C.

In another embodiment of the present invention, a PTC device using a PTC composition comprises a material having PTC characteristics disposed between electrodes, wherein said material is a PTC composition comprising at least one polymer, from 5% to 45% by volume of electrically conductive or semiconductive particles having a room temperature electric conductivity of at least $10^2$ [s/m] dispersed in said polymer, and from 0.2% to 20% by volume of thermally conductive particles having a room temperature electric conductivity of no more than $10^{-3}$ [s/m] and a thermal conductivity of at least 20 [w/m·k] dispersed in said polymer.

DETAILED DESCRIPTION OF THE INVENTION

Figure 1:
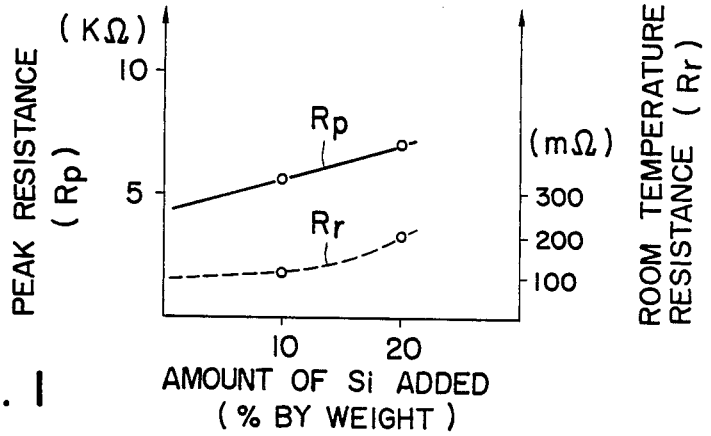
FIG. 1 is a diagrammatic view showing the resistance-Si level characteristics of a PTC composition according to the present invention.

The present invention will be more fully described.

Polymer

Examples of the polymers which can be used in the present invention include polyethylene, polyethylene oxide, polybutadiene, polyethylene acrylates, ethylene-ethyl acrylate copulymers, ethylene-acrylic acid copolymers, polyerters, polyamides, polyethers, polycaprolactam, fluorinated ethylene-propylene copolymers, chlorinated polyethylene, chlorosulfonated polyethylene, ethyl-vinyl acetate copolymers polypropylene, polystyrene, styrene-acrylonitrile copolymers, polyvinyl chloride, polycarbonates, polyacetals, polyalkylene oxides, polyphenyl oxide, pulysulfrenes, fluoroplastics, and blend polymers of at least two polymers selected from the polymers described above. In the present invention, the type of the polymers and compositional ratios can be varied depending on desired performance, uses or the like.

ELECTRICALLY CONDUCTIVE PARTICLES

Electrically conductive or semiconductive particles (hereinafter referred to as electrically conductive particles) dispersed in the polymer are composed of electrically conductive materials having a room temperature electric conductivity of at least $10^2$ [s/m]. Examples of such particles which can be used herein include particles of electrically conductive materials such as carbon black, silver powder, gold powder, carbon powder, graphite, copper powder, carbon fibers, nickel powder, silver plated fine particles. It is desirable to vary the particle size and specific area of the electrically conductive particles depending upon the uses and desired characteristics of the PTC composition.

THERMALLY CONDUCTIVE PARTICLES

In the present invention, thermally conductive particles dispersed in the polymer are composed of thermally conductive materials having a room temperature electric conductivity of no more than $10^{-1}$ [s/m], preferably no more than $10^{-3}$ [s/m] and a thermal conductivity of at least 20 [w/m·k]. Examples of such thermally conductive particles include semiconductors and electrically insulating materials such as at least one material selected from silicon, selenium, SiC, $Si_3N_4$, BeO and $Al_2O_3$, and mixtures thereof. The particle size, and specific area of the thermally conductive particles can be varied depending on the uses and desired characteristics of the PTC composition. For example, some thermally conductive particles have an average particle size of from 1 to 200 microns.

PTC Composition

In preparing the PTC composition, optional various additives can be admixed in addition to the polymer, the electrically conductive particles and thermally conductive particles. Examples of such additives include flame retardants such as antimony-containing compounds, phosphorus-containing compounds, chlorinated compounds and brominated compounds, antirexidants and stabilizers.

In the present invention, a PTC composition is prepared by blending and kneading its raw materials, a polymer, electrically conductive particles, thermally conductive particles and other additives in predetermined ratios. A PTC composition can be prepared by incorporating electrically conductive particles in a polymer and then incorporating thermally conductive particles therein. A PTC composition can also be prepared by incorporating thermally conductive particles in a polymer and then incorporating electrically conductive particles therein. Further, a PTC composition can be prepared by incorporating thermally conductive particles and electrically conductive particles in a polymer at the same time. When at least two polymers are used, kneading the polymers with electrically conductive particles and thermally conductive particles can be carried out by preblending each polymer with electrically conductive particles and thermally conductive particles and then kneading each preblend in a predetermined ratio. This kneading is carried out by kneading the polymer with the electrically conductive particles and the thermally conductive particles. While the blend ratios of polymer to particles can be varied depending on the content of particles in a desired composition, the type of a polymer, the type of a mixer or kneader, or the like, in the present invention, the amount of the electrically conductive particles is from 5% to 45% by volume, preferably from 23% to 38% by volume and the amount of the thermally conductive particles is from 0.2% to 20% by volume, preferably from 0.2 to 5% by volume. In the present invention, pretreatments such as grinding, heating and mixing can be carried out prior to kneading. The kneading temperature is from the melting point of the polymer to be kneaded to a temperature higher by 80° C., preferably 50° C. than the melting point of the polymer. This is because the polymer to be kneaded can gel to uniformly disperse the electrically conductive particles therein.

When additives are incorporated in the PTC composition, the additives can be added before or after premixing, before or after kneading, or during premixing or kneading.

The PTC composition obtained by the present invention can be used in various uses. The PTC composition can be used to produce a PTC device having the PTC composition disposed between electrodes. When the PTC composition is used in a PTC device, the PTC device can be produced by forming the PTC composition into a film, hot pressing metallic foil electrodes to the upper and lower surfaces of the film to form a laminate, cutting this laminate into a predetermined size and electrically connecting a lead wire to the surface of each of the electrodes.

Because the present invention is constituted as described above, it acts as follows:

In the PTC composition wherein the electrically conductive particles such as carbon black are dispersed in the polymer such as polyethylene, polyethylene has a low thermal conductivity of 3,4 (w/m·k) and carbon black also has a low thermal conductivity (15.5 w/m·k). Accordingly, the thermal conductivity of the PTC composition is inferior and the heat distribution occurs in a direction perpendicular to the equipotential surface. Only a portion of the PTC composition exhibits PTC characteristics to become a high restance due to the heat distribution. Accordingly, it is believed that the peak resistance is not increased in proportion to the thickness even if the thickness of the PTC composition is increased, and that the peak resistance reaches a plateau in the case of a certain thickness or above. It is also believed that the heat distribution is present in a surface direction, thereby only a portion of the PTC composition is raised to a higher temperature to occur the breakdown of the device and that higher portions and lower portions in resistance value occur and the peak resistance is lower than the peak resistance inherent to the device. In the present invention, the thermally conductive particles are further dispersed into the polymer, and therefore the heat conduction of the PTC composition is improved, and the heat distribution in the PTC composition is relaxed. Partially high resistance is eliminated and no peak resistance reaches a plateau. Furthermore, the thermally conductive particles have a low electric conductivity and therefore the peak resistance is not reduced.

EXAMPLE

In order to indicate more fully the nature and utility of this invention, the following examples are set forth, it being understood that these examples are presented as illustrative only and are not intended to limit the scope of the invention. All parts used herein are by weight unless otherwise specified.

EXAMPLE 1

Six parts of Si powder (available from Wako Junyaku Co. under the tradename No. 198-05455) were added to 17.6 parts of high density polyethylene (hereinafter referred to as HDPE; available from Toyo Soda Co. under the tradename Niporon Hard 5100), 17.6 parts of an ethylene-acrylic acid copolymer (hereinafter referred to EAA; available from Mitsubishi Yuka Co. under the tradename A201K) and 28 parts of carbon black (available from Cabot Co. under the tradename STERLING SO). The mixture was kneaded at a temperature of 180° C. by means of a twin-screw roll mill, and formed into a film. Nickel foils each having a thickness of 60 micrometers were hot pressed to both the surfaces of the film of the PTC composition to prepare a PTC device. The size of the device was 10.5×10.5 millimeter, and the thickness of the PTC composition was 0.25 millimeter. Current was passed through the resulting PTC device to occur self-heat generation and the peak resistance was measured. As a result, the peak resistance was 6 kilohms. The room temperature resistance was 120 milliohms.

PTC devices were prepared and their peak resistance (kilohm) and room temperature resistance (milliohm) were measured as described above except that the amount of Si powder was changed. The results are shown in FIG. 1. As can be seen from this FIG, the peak resistance increases with increasing the amount of Si powder added.

PTC devices were prepared and their peak resistance (kilohm) and room temperature resistance (milliohm) were measured as described above except that the amount of Si powder was changed. The results are shown in FIG. 1. As can be seen from this FIG., the peak resistance increases with increasing the amount of Si powder added.

Figure 2:
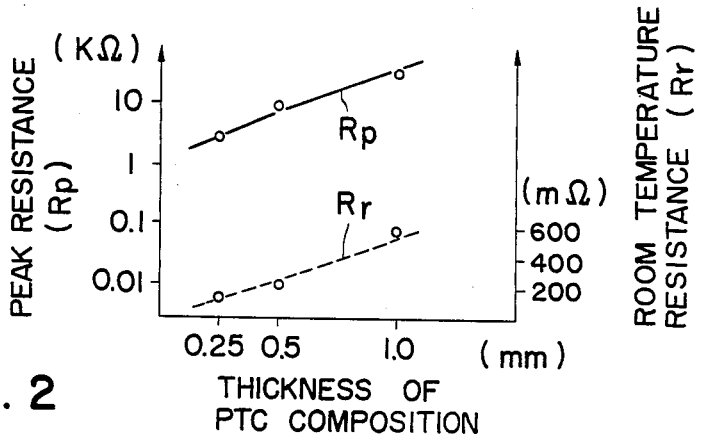
FIG. 2 is a diagrammatic view showing the peak resistance-thickness characteristics of a PTC composition of the present invention.

PTC devices were prepared and their peak resistance (kilohm) and room temperature resistance (milliohm) were measured as described above except that the thickness of the PTC compositions was changed. The results are shown in FIG. 2. As can be seen from this FIG., the peak resistance increases with increasing the thickness of the PTC compositions, and the peak resistance does not reach a plateau.

EXAMPLE 2 (COMPARATIVE EXAMPLE)

Figure 3:
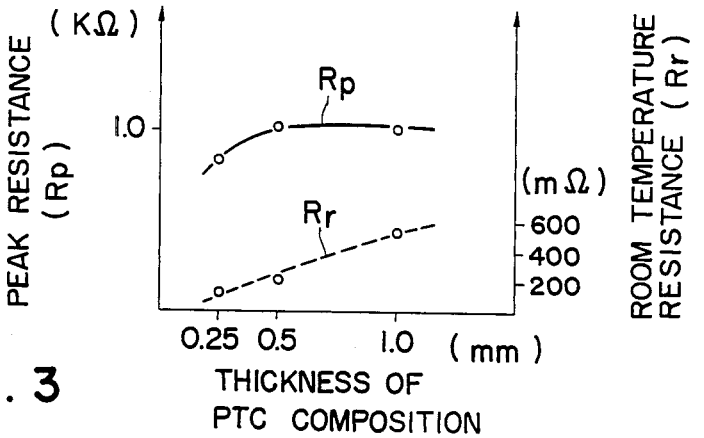
FIG. 3 is a diagrammatic view showing the peak resistance-thickness characteristics of the prior art PTC composition.

PTC compositions were prepared by prior art. Forty eight parts of carbon black were added to 26 parts of EAA and 26 parts of HDPE, and the mixture was kneaded to prepare PTC compositions. The PTC compositions were tested as in Example 1 for their characteristics. The results are shown in FIG. 3.

As can be seen from comparison of Examples 1 and 2, the peak resistance does not reach a plateau in Example 1, and thus the PTC composition according to the present invention has excellent characteristics.

What is claimed is:

1. A PTC composition having a sharply increasing electrical resistance within a narrow temperature range comprising (a) a solid matrix of one or more polymers, (b) 5 to 45% by volume of electrically conductive or semiconductive particles having a room temperature electric conductivity of at least $10^2$ (s/m) dispersed in said matrix, and (c) 0.2 to 5% by volume of thermally conductive particles having a room temperature electric conductivity of less than $10^{-3}$ (s/m) and a thermal conductivity of at least about 148 (w/m·k) dispersed in said matrix, wherein the matrix remains a solid throughout the narrow temperature range.

2. The PTC composition according to claim 1 wherein said thermally conductive particles are composed of at least one material selected from the group consisting of silicon, and beryllia.

3. The PTC composition according to claim 1 wherein said thermally conductive particles have an average particle size of from 1 to 200 micrometers.

4. A process for preparing a PTC composition having a sharply increasing electrical resistance within a narrow temperature range comprising the steps of (a) preparing a mixture of (1) one or more polymers, (2) 5 to 45% by volume of electrically conductive or semiconductive particles having a room temperature electric conductivity of at least $10^2$ (s/m) dispersed in said matrix, and (3) 0.2 to 5% by volume of thermally conductive particles having a room temperature electric conductivity of less than $10^{-3}$ (s/m) and a thermal conductivity of at least about 148 (w/m·k), and (b) kneading the mixture at a temperature ranging from the highest melting point $T_m$ of the melting points of the polymers to $T_m+80°$ C. to thereby disperse the particles in a matrix of the polymers, wherein the matrix is a solid throughout the narrow temperature range in which the PTC composition has a sharply increasing electrical resistance.

5. A PTC device comprising a PTC composition disposed between electrodes, wherein the PTC composition has a sharply increasing electrical resistance within a narrow temperature range and comprises (a) a solid matrix of at least one polymer, (b) 5 to 45% by volume of electrically conductive or semiconductive particles having a room temperature electric conductivity of at least $10^2$ (s/m) dispersed in said matrix, and (c) 0.2 to 5% by volume of thermally conductive particles having a room temperature electric conductivity of less than $10^{-3}$ (s/m) and a thermal conductivity of at least about 148 (w/m·k) dispersed in said matrix, wherein the matrix remains a solid throughout the narrow temperature range.

6. The PTC device according to claim 5 wherein said thermally conductive particles are composed of at least one material selected from the group consisting of silicon, and beryllia.

* * * * *